US008088722B2

(12) United States Patent
Barnabas et al.

(10) Patent No.: US 8,088,722 B2
(45) Date of Patent: Jan. 3, 2012

(54) AQUEOUS LIQUID COMPOSITION FOR PRE-TREATING SOILED DISHWARE

(75) Inventors: Freddy Arthur Barnabas, West Chester, OH (US); Jennifer Lynn Treadway, Taylor Mill, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/785,677

(22) Filed: May 24, 2010

(65) Prior Publication Data

US 2010/0305016 A1 Dec. 2, 2010

Related U.S. Application Data

(60) Provisional application No. 61/181,055, filed on May 26, 2009.

(51) Int. Cl.
*C11D 17/00* (2006.01)

(52) U.S. Cl. ..... 510/218; 510/421; 510/422; 510/463; 510/505

(58) Field of Classification Search ..... None
See application file for complete search history.

(56) References Cited

U.S. PATENT DOCUMENTS

| | | | |
|---|---|---|---|
| 4,435,307 A | 3/1984 | Barbesgaard et al. | |
| 5,102,573 A | 4/1992 | Han et al. | |
| 5,411,585 A | 5/1995 | Avery et al. | |
| 5,929,007 A | 7/1999 | Feng | |
| 6,060,299 A | 5/2000 | Sreekrishna et al. | |
| 6,579,839 B2 | 6/2003 | Price et al. | |
| 2003/0100464 A1 * | 5/2003 | Kott et al. | 510/357 |

FOREIGN PATENT DOCUMENTS

| | | | |
|---|---|---|---|
| EP | 0 629 691 | A1 | 12/1994 |
| EP | 0 130 756 | B2 | 6/2000 |
| GB | 1296839 | A | 11/1972 |
| WO | WO 91/06637 | A1 | 5/1991 |
| WO | WO 94/02597 | A1 | 2/1994 |
| WO | WO 94/28108 | A1 | 12/1994 |
| WO | WO 95/07971 | A1 | 3/1995 |
| WO | WO 95/10591 | A1 | 4/1995 |
| WO | WO 95/26393 | A1 | 10/1995 |
| WO | WO 96/23873 | A1 | 8/1996 |
| WO | WO 96/33267 | A1 | 10/1996 |
| WO | WO 99/02663 | A1 | 1/1999 |
| WO | WO 99/20726 | A1 | 4/1999 |
| WO | WO 99/27083 | A1 | 6/1999 |
| WO | WO 01/00760 | A1 | 1/2001 |
| WO | WO 2004/101759 | A2 | 11/2004 |
| WO | WO 2004/101760 | A2 | 11/2004 |
| WO | WO 2004/101763 | A2 | 11/2004 |

OTHER PUBLICATIONS

International Search Report; International Application No. PCT/US2010/035338; Mailed Aug. 25, 2010; 14 pages.

* cited by examiner

*Primary Examiner* — Necholus Ogden, Jr.
(74) *Attorney, Agent, or Firm* — John T. Dipre; David V. Upite; Leonard W. Lewis

(57) ABSTRACT

A liquid detergent composition comprising: from about 0.05 wt. % to about 5 wt. % of super wetting agent; from about 0.05 wt. % to about 10 wt. % of a non-ionic surfactant selected from short chain surfactants and branched surfactants; from about 0.05 wt. % to about 2 wt. % of a chelant; and from about 50 wt. % to about 95 wt. % of water.

20 Claims, No Drawings

AQUEOUS LIQUID COMPOSITION FOR PRE-TREATING SOILED DISHWARE

CROSS-REFERENCES TO RELATED APPLICATION

The present application claims the benefit of U.S. Provisional Application Ser. No. 61/181,055, filed May 26, 2009.

FIELD OF THE INVENTION

The present invention relates to an aqueous pretreater composition which is suitable for removing cooked-, baked-, and burnt-on soils from hard surfaces, and particularly from dishware.

BACKGROUND OF THE INVENTION

Cooked-, baked- and burnt-on soils are amongst the most severe types of soils to remove from surfaces. Traditionally, the removal of cooked-, baked- and burnt-on soils from cookware and tableware requires soaking the soiled object prior to a mechanical action. Apparently, the automatic dishwashing process alone does not provide a satisfactory removal of cooked-, baked- and burnt-on soils. Manual dishwashing process requires a tremendous rubbing effort to remove cooked-, baked- and burnt-on soils and this can be detrimental to the safety and condition of the cookware/tableware.

The use of cleaning compositions containing solvent for helping in the removal of cooked-, baked- and burnt-on solids is known in the art. For example, U.S. Pat. No. 5,102,573 provides a method for treating hard surfaces soiled with cooked-on, baked-on or dried-on food residues comprising applying a pre-spotting composition to the soiled article. The composition applied comprises surfactant, builder, amine and solvent. U.S. Pat. No. 5,929,007 provides an aqueous hard surface cleaning composition for removing hardened dried or baked-on grease soil deposits. The composition comprises nonionic surfactant, chelating agent, caustic, a glycol ether solvent system, organic amine and anti-redeposition agents. WO-A-94/28108 discloses an aqueous cleaner concentrate composition that can be diluted to form a more viscous solution comprising an effective thickening amount of a rod micelle thickener composition, lower alkyl glycol ether solvent and hardness sequestering agent. The application also describes a method of cleaning a food preparation unit having at least one substantially vertical surface having a baked food soil coating. In practice, however, the previous formulations suffer from insufficient removal baked-on, polymerized soil from metal and other substrates. Other formulations suffer from the creation of significant malodor due to organic solvents and cleaning agents.

Thus, there is still need for cleaning compositions and methods used prior to the washing process of tableware and cookware soiled with cooked-on, baked-on or burnt-on food in order to facilitate the removal of these difficult food residues. There is also a need for cleaning compositions and methods having improved efficacy in baked-on soil removal without creation of malodor and/or fumes.

SUMMARY OF THE INVENTION

The present invention comprises an aqueous composition for pretreating dishware comprising: from about 0.05 wt. % to about 5 wt. % of super wetting agent; from about 0.05 wt. % to about 10 wt. % of a non-ionic surfactant selected from short chain surfactants and branched surfactants; from about 0.05 wt. % to about 2 wt. % of a chelant; and from about 50 wt. % to about 95 wt. % of water.

In another embodiment, the compositions herein are used in dishwashing applications, including hand dishwashing—as well as washing with automatic dishwashing machines. It has been found that the present compositions give particularly good cleaning performance, especially in terms of soil removal when used as a pretreatment composition for treating dishes especially pans, pots kitchen grills and/or any kitchenware soiled by though food stains/encrustations.

Accordingly the present invention encompasses a process of treating dishes which comprises the steps of contacting said dishes with a composition according to the present invention in its diluted or neat form, then allowing said dishes to remain in contact with said composition for a period of time sufficient to treat said dishes, preferably from 2 to 15 minutes, then rinsing said dishes in water to remove said composition. Said process mentioned herein may be followed by a subsequent step where said dishes are washed with a dishwashing detergent product. Indeed said subsequent step may be either a hand dishwashing operation or a dishwashing performed in automatic dishwashing machines.

DETAILED DESCRIPTION OF THE INVENTION

As used herein, the term "dish" or "dishes" means any tableware (plates, bowls, glasses, mugs), cookware (pots, pans, baking dishes), glassware, silverware or flatware and cutlery, cutting board, food preparation equipment, etc. which is washed prior to or after contacting food, being used in a food preparation process and/or in the serving of food.

As used herein "light dish load" means the following number and type of dishes: 2 dinner plates (30.5 cm diameter), 1 salad plate (12 cm diameter), 2 bowls (12.5 cm diameter, 4.5 cm depth), 2 glasses (250 mL volume), 2 mugs (250 mL volume), 2 sets of silverware (spoons, forks, knives), 1 larger silver spoon and 1 plastic stirring spoon. "Everyday dish load" means all the "light load" items, plus 1 frying pan (aluminum 21 cm diameter), 1 casserole dish (Pyrex®; 20 cm by 20 cm), 1 pot (aluminum, 12.5 cm diameter, 6 cm depth), and 1 plastic container (round, 500 mL volume).

As used herein "soils" or "tough soils" refers to the soils on dishes discussed further below in the test method section including oatmeal, corn flakes, macaroni and cheese, Italian salad dressing, mashed potatoes, hamburger, tomato sauce, milk, coffee, and hamburger grease.

As used herein "dry" means that a material is substantially free of water, i.e., no water has been added or present other than the moisture of the raw materials themselves. Typically, the level of water is below 10% by weight of the total material and preferably below 5% by weight of the total material.

As used herein, the term "pretreater" means a composition which is applied to a hard surface, particularly dishware, and after a soaking time period, aids in soil removal. After application of the composition, the hard surface may be subsequently cleaned by the methods described herein.

As used herein "wet" means that a material comprises a level of water above 10% by weight of the material.

As used herein "nonwoven substrate" can comprise any conventionally fashioned nonwoven sheet or web having suitable basis weight, caliper (thickness), absorbency and strength characteristics. Examples of suitable commercially available nonwoven substrates include those marketed under the tradename SONTARA® by DuPont and POLYWEB® by James River Corp.

As used herein, the terms "foam" and "suds" are used interchangeably and indicate discrete bubbles of gas bounded by and suspended in a liquid phase.

Unless otherwise indicated, weight percentage is in reference to weight percentage of the liquid detergent composition. All temperatures, unless otherwise indicated are in Celsius.

Unless otherwise indicated, molecular weights are measured as weight-average molecular weights.

Wetting Agent

The present compositions comprise at least one wetting agent. Among such wetting agents, those which are commonly referred to as "super wetting agents" are particularly preferred. Without being limited to theory, it is believed that super wetting agents improve the spread of the compositions herein. This action assists by driving the composition to the soil-substrate interface, where dynamic surface tension is affected by the composition. It has further been found that the overall effectiveness of the composition in removing soil may be predicted based upon the speed at which the super wetting agent drives the composition to the soil-substrate interface.

Wetting agents suitable for use as spreading auxiliaries herein are surfactants and include anionic, amphoteric, zwitterionic, nonionic and semi-polar surfactants. Preferred non-ionic surfactants include silicone surfactants, such as Silwet copolymers, preferred Silwet copolymers include Silwet L-8610, Silwet L-8600, Silwet L-77, Silwet L-7657, Silwet L-7650, Silwet L-7607, Silwet L-7604, Silwet L-7600, Silwet L-7280 and mixtures thereof. Preferred for use herein is Silwet L-77.

Other suitable wetting agents include organo amine surfactants, for example amine oxide surfactants. Preferably, the amine oxide contains an average of from 12 to 18 carbon atoms in the alkyl moiety, highly preferred herein being dodecyl dimethyl amine oxide, tetradecyl dimethyl amine oxide, hexadecyl dimethyl amine oxide and mixtures thereof.

Suitable super wetting agents include organosilicate surfactants, organomodified siloxanes, and acetylene glycol surfactants. Particularly useful are Surfynol® surfactants manufactured by Air Products & Chemicals. More specifically, "Surfynols® GA, 82, 102, 465, 485 & 136"™ perform acceptably, with Surfynol® 102, 104pg50, and 465 being the most preferred.

The (super) wetting agents are comprised in the present compositions in an amount of from about 0.05 wt. % to about 5 wt. %, and preferably from about 0.10 wt. % to about 2 wt. %.

Non-Ionic Surfactant

The detergent compositions comprise at least one non-ionic surfactant. The non-ionic surfactant is present in an effective amount, more preferably from 0.1% to 20%, even more preferably 0.1% to 15%, even more preferably still from 0.5% to 10%, by weight of the composition.

Suitable nonionic surfactants include the condensation products of aliphatic alcohols with from 1 to 25 moles of ethylene oxide. The alkyl chain of the aliphatic alcohol can either be straight or preferably branched, primary or secondary, and are generally short chain surfactants. "Short chain" surfactants, as used herein, means that the surfactant chain contains from 8 to 15, and more preferably 9 to 12 carbon atoms. Particularly preferred are the condensation products of alcohols having an alkyl group containing from 10 to 20 carbon atoms with from 2 to 18 moles of ethylene oxide per mole of alcohol. Also suitable are alkylpolyglycosides having the formula $R^2O(C_nH_{2n}O)_t(\text{glycosyl})_x$ (formula (I)), wherein $R^2$ of formula (I) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (I) is 2 or 3, preferably 2; t of formula (I) is from 0 to 10, preferably 0; and x of formula (I) is from 1.3 to 10, preferably from 1.3 to 3, most preferably from 1.3 to 2.7. The glycosyl is preferably derived from glucose. To prepare these compounds, the alcohol or alkylpolyethoy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Also suitable are fatty acid amide surfactants having the formula (II):

$$R^6\overset{\overset{\displaystyle O}{\|}}{C}N(R^7)_2 \qquad \text{(II)}$$

wherein $R^6$ of formula (II) is an alkyl group containing from 7 to 21, preferably from 9 to 17, carbon atoms and each $R^7$ of formula (II) is selected from the group consisting of hydrogen, $C_1$-$C_4$ alkyl, $C_1$-$C_4$ hydroxyalkyl, and $—(C_2H_4O)_xH$ where x of formula (II) varies from 1 to 3. Preferred amides are $C_8$-$C_{20}$ ammonia amides, monoethanolamides, diethanolamides, and isopropanolamides.

Preferred non-ionic surfactants include the Novel® series available from Sasol.

When present, nonionic surfactants comprise from about 0.01% to about 20%, preferably from about 0.5% to about 10% by weight of the composition.

Chelant

The present compositions comprise at least one chelating agent. It has been found that the presence of a chelating agent aids in prevention of the formation of soap residue on hard surfaces In one embodiment the chelating agent is a biodegradable chelating agent such as methylglycine-N—N-diacetic acid ("MGDA" or Trilon®-M from BASF) or its alkali metal salt, ethylglycine-N—N-diacetic acid or its alkali metal salt. Most preferably, the biodegradable chelating agent is methylglycine-N—N-diacetic acid or its sodium salt, tetrasodium carboxylatomethyl-glutamate (Dissolvine® or GLDA from Akzo Nobel), citric acid, and the like. The chelants may be present at a level of 0.1 to 1.0%, more preferably at a level of 0.1 to 0.7% and most preferably at a level of 0.1 to 0.5%.

Water

The present compositions comprise water. Water is generally present in an amount of from about 10% to about 95%, and preferably from about 50% to about 95%, and more preferably from about 70% to about 95% of the composition.

Optional Ingredients

Non-exhaustive examples of optional ingredients include stabilizing agents, suds boosting polymers, suds stabilizing materials, hydrotopes, solvents, thickeners, processing aids, enzymes, enzyme stabilizers, bleach, bleach stabilizers, perfumes, dyes, opacifiers, and pH buffering means.

Enzymes

Enzymes can be included in effective amounts in the composition herein. As used herein, an "effective amount" is an amount of additional enzyme to achieve the desired removal of a soil from the dish surface.

Examples of suitable enzymes include, but are not limited to, hemicellulases, peroxidases, proteases, cellulases, xylanases, lipases other than those described above, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, or combinations thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents.

A potential enzyme combination comprises a cocktail of conventional detersive enzymes like protease, lipase, cutinase and/or cellulase in conjunction with amylase. Detersive enzymes are described in greater detail in U.S. Pat. No. 6,579,839. Particularly preferred compositions herein contain from 0.01% to about 0.5% by weight of the composition of enzymes.

Proteases useful herein include those like subtilisins from *Bacillus* [e.g. *subtilis, lentus, licheniformis, amyloliquefaciens* (BPN, BPN'), *alcalophilus*] e.g. ESPERASE®, ALCALASE®, EVERLASE® and SAVINASE® (Novozymes), BLAP and variants (Henkel). Further proteases are described in EP130756, WO91/06637, WO95/10591 and WO99/20726.

Amylases (α and/or β) are described in WO 94/02597 and WO 96/23873. Commercial examples are PURAFECT OX AM® (Genencor) and TERMAMYL®, NATALASE®, BAN®, FUNGAMYL® and DURAMYL® (all ex Novozymes). Amylases also include, for example, α-amylases described in British Patent Specification No. 1,296,839 (Novozymes), and RAPIDASE® (International Bio-Synthetics, Inc).

The cellulases usable in the present composition include either bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984. Cellulases useful herein include bacterial or fungal cellulases, e.g. produced by *Humicola insolens*, particularly DSM 1800, e.g. 50 Kda and ~43 kD (CAREZYME). Also suitable cellulases are the EGI cellulases from *Trichoderma longibrachiatum*.

Other suitable lipases not described above include those produced by *Pseudomonas* and *Chromobacter* groups. The LIPOLASE® enzyme derived from *Humicola lanuginosa* and commercially available from Novozymes (see also EPO 41,947) is a suitable lipase for use herein. Also suitable are e.g., LIPOLASE ULTRA®, LIPOPRIME® and LIPEX® from Novozymes. Also suitable are cutinases [EC 3.1.1.50] and esterases. See also lipases in Japanese Patent Application 53-020487, laid open to public inspection on Feb. 24, 1978. This lipase is available from Areario Pharmaceutical Co. Ltd., Nagoya, Japan, under the trade name LIPASE P "AMANO®". Other commercial lipases include AMANO-CES®, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Diosynth Co., Netherlands, and other lipases such as *Pseudomonas gladioli*. Further suitable lipases are described in WO 2004/101759, WO 2004/101760 and WO 2004/101763.

Carbohydrases useful herein include mannanase (e.g., those disclosed in U.S. Pat. No. 6,060,299), pectate lyase (e.g., those disclosed in WO 99/27083), cyclomaltodextringlucanotransferase (e.g., those disclosed in WO 96/33267), xyloglucanase (e.g., those disclosed in WO 99/02663).

Bleaching enzymes useful herein with enhancers include peroxidases, laccases, oxygenases, (e.g., catechol 1,2 dioxygenase), lipoxygenase (e.g., those disclosed in WO 95/26393), and (non-heme) haloperoxidases.

Bleach System

The compositions may optionally include from about 0.1 wt % to about 20 wt % by weight of the composition of a bleaching system. Non-limiting examples of bleaching systems include hypohalite bleaches, peroxygen bleaching systems, or transition metal nil peroxygen systems. Peroxygen systems typically comprise a "bleaching agent" (source of hydrogen peroxide) and an "initiator" or "catalyst", however, pre-formed bleaching agents are included. Catalysts for peroxygen systems can include transition metal systems. In addition, certain transition metal complexes are capable of providing a bleaching system without the presence of a source of hydrogen peroxide.

Hydrogen peroxide sources are described in detail in Kirk Othmer's Encyclopedia of Chemical Technology, 4th Ed (1992, John Wiley & Sons), Vol. 4, pp. 271-300 "Bleaching Agents (Survey)", and include the various forms of sodium perborate and sodium percarbonate, including various coated and modified forms.

Non-limiting examples of activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof.

The pretreater compositions of the present invention optionally comprise a bleaching system which contains one or more bleach catalysts. Selected bleach catalysts inter alia 5,12-dimethyl-1,5,8,12-tertaaza-bicyclo[6.6.2]hexadecane manganese (II) chloride may be formulated into bleaching systems which do not require a source of hydrogen peroxide or peroxygen bleach.

pH Buffer

The detergent compositions will be subjected to acidic stresses created by food soils when put to use, i.e., diluted and applied to soiled dishes. If a composition with a pH greater than 7 is to be more effective, it preferably should contain a buffering agent capable of providing a generally more alkaline pH in the composition and in dilute solutions, i.e., about 0.1 wt. % to 0.4 wt. % of the composition. The pKa value of this buffering agent should be about 0.5 to 1.0 pH units below the desired pH value of the composition (determined as described above). Preferably, the pKa of the buffering agent should be from about 7 to about 10. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Such suitable buffering agents may include nitrogen-containing materials such as lysine or lower alcohol amines; inorganic buffers/alkalinity sources such as alkali metal carbonates and alkali metal phosphates, e.g., sodium carbonate, sodium polyphosphate; or sodium hydroxide. Agents which do not include phosphates are preferred. For additional buffers see McCutcheon's EMULSIFIERS AND DETERGENTS, North American Edition, 1997, McCutcheon Division, MC Publishing Company Kirk and WO 95/07971.

The buffering agent, if used, is present in the compositions of the invention herein at a level of from about 0.05% to 15%, preferably from about 0.1% to 10%, most preferably from about 0.5% to 8%, by weight of the composition.

Thickening Agent

When thickening agents are employed in the instant compositions, they should be at a concentration of about 0.01 to about 5.0 wt. %, more preferably 0.025 to about 2.0 wt. % and most preferably about 0.05 to about 1.5 wt. %. They are used to adjust the Brookfield viscosity of the composition to about 20 to about 1,000 cps, more preferably about 100 to 600 cps and most preferably about 140 to 550 cps as measured at 10 rpm in a Brookfield DV II, #1 spindle so that the compositions do not run off, but rather adhere to plates stacked in a non-horizontal alignment, preferably a vertical alignment. Useful thickening agents are selected from the group consisting of xanthan gum, welan gum, rhamsan gum, carboxymethyl cellulose, hydroxyalkyl cellulose (hydroxyethyl cellulose), alkyl cellulose, guar gum, locust bean gum, and polysaccharides with beta glycoside linkages and mixtures thereof. Maleic anhydride polymers, maleic anhydride-methyl vinyl ether copolymers and polyacrylic acid thickeners are also useful. However, it is preferred that thickeners not be used which include Ca ions, as the ions may interact with the chelating agents herein.

The compositions of the present invention may be used for a variety of cleaning purposes such as cleaning hard surfaces whereby said compositions thickened nature result in longer adhesion to the surface than non-thickened compositions. Said compositions are particularly suitable in the cleaning of inclined surfaces including toilet bowls.

In another embodiment of the present invention the compositions herein are used in dishwashing applications, including hand dishwashing—as well as washing with automatic dishwashing machines. It has been found that said compositions give particularly good cleaning performance, especially in terms of soil removal when used as a pretreatment composition for treating dishes especially pans, pots kitchen grills and/or any kitchenware soiled by though food stains/encrustations.

Accordingly the present invention encompasses a process of treating dishes which comprises the steps of contacting said dishes with a composition according to the present invention in its diluted or neat form, then allowing said dishes to remain in contact with said composition for a period of time sufficient to treat said dishes, preferably from 2 to 15 minutes, then rinsing said dishes in water to remove said composition. Said process mentioned herein may be followed by a subsequent step where said dishes are washed with a dishwashing product including the one of the present invention or any other conventional dishwashing product. Indeed said subsequent step may be either a hand dishwashing operation or a dishwashing performed in automatic dishwashing machines.

Alternatively said process of treating dishes mentioned herein before can be preceded by a step where said dishes are soaked in water before being contacted with a composition of the present invention.

By "in its diluted form" it is meant herein that the compositions according to the present invention may be diluted with water. Typically dilution levels are of from 0.5% to 3% by weight of a composition of the present invention in water. Said dilution may occur before or while a composition of the present invention is applied to said dishes.

EXAMPLES

| | Examples | | | | | | |
|---|---|---|---|---|---|---|---|
| | EXAMPLE COMPOSITION | | | | | | |
| Ingredient | I | II | I | IV | V | VI | VII |
| Water | q.s. | q.s. | q.s. | q.s. | q.s. | q.s. | q.s. |
| Surfactant [1] | 1.00 | 1.25 | 1.00 | 1.50 | 1.25 | 1.00 | — |
| Surfactant [2] | 2.00 | 0.25 | — | 0.25 | — | 0.25 | 2.00 |
| Super Wetter [3] | 0.60 | 0.75 | 0.50 | — | 0.75 | 1.00 | 0.80 |
| Super Wetter [4] | 0.20 | 0.10 | 0.25 | 1.00 | 0.10 | — | — |
| Chelant [5] | 0.50 | 1.00 | — | 0.75 | 0.80 | 0.80 | — |
| Chelant [6] | 0.50 | — | 1.00 | 0.10 | — | 0.10 | 1.00 |
| Phenoxy Ethanol | 0.05 | 0.05 | 0.05 | 0.05 | 0.05 | 0.05 | 0.05 |
| Fragrance | 0.70 | 0.70 | 0.70 | 0.70 | 0.70 | 0.70 | 0.70 |
| Preservatives, pH adjusters, structurants, colorants | Up to 2% | Up to 2% | Up to 2% | Up to 2% | Up to 2% | Up to 2% | Up to 2% |

[1] Berol ® 508 available from Akzo Nobel
[2] Surfonic ® L24-9 available from Huntsman
[3] Surfynol ® 465 available from Air Products
[4] Surfynol ® 104pg50 available from Air Products
[5] Dissolvine ® GL available from Akzo Nobel
[6] Trilon ®M available from BASF The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

a) from about 0.05 wt. % to about 5 wt. % of acetylene glycol surfactant;

b) from about 0.05 wt. % to about 10 wt. % of a non-ionic surfactant selected from straight short chain and branched short chain surfactants;

c) from about 0.05 wt. % to about 2 wt. % of a chelant; and d) from about 50 wt. % to about 95 wt. % of water, wherein the detergent composition does not include a surfactant other than the acetylene glycol and non-ionic surfactants.

2. A method of pre-treating soiled dishware comprising the steps of:

a) contacting soiled dishware with a composition according to claim 1;

b) allowing said dishware to soak in said composition for at least 5 minutes; and c) rinsing said dishware with water.

3. A method of pre-treating soiled dishware comprising the steps of a) contacting soiled dishware with a composition according to claim 1;

b) allowing said dishware to soak in said composition for at least 5 minutes; and c) washing said dishware in an automatic dishwasher.

4. A liquid detergent composition according to claim 1, wherein said composition further comprises a thickener.

5. A liquid detergent composition according to claim 4, wherein said thickener is selected from the group consisting of xanthan gum, welan gum, rhamsan gum, carboxymethyl cellulose, hydroxyalkyl cellulose, alkyl cellulose, guar gum, locust bean gum, and polysaccharides with beta glycoside linkages and mixtures thereof.

6. A composition according to claim 1, wherein said chelant is selected from GLDA and MGDA.

7. A composition according to claim 1, wherein said non-ionic surfactant is a branched nonionic surfactant.

8. A composition according to claim 1, further comprising an additional wetting agent.

9. A composition according to claim 1, further comprising one or more enzymes.

10. A composition according to claim 1, further comprising a bleach system.

11. A composition according to claim 1, further comprising a pH buffer.

12. A composition according to claim 5, wherein the thickener is selected from xanthan gum, welan gum, rhamsan gum, guar gum, locust bean gum, and mixtures thereof.

13. A composition according to claim 5, wherein said thickener is selected from the group consisting of carboxymethyl cellulose, hydroxyalkyl cellulose, and mixtures thereof.

14. A liquid detergent composition according to claim 5, wherein said thickener is a polysaccharides with beta glycoside linkages.

15. The composition of claim 12, wherein said chelant is selected from GLDA and MGDA.

16. The composition of claim 13, wherein said chelant is selected from GLDA and MGDA.

17. The composition of claim 14, wherein said chelant is selected from GLDA and MGDA.

18. The composition of claim 15, further comprising one or more enzymes, a bleach system, and a pH buffer.

19. The composition of claim 16, further comprising one or more enzymes, a bleach system, and a pH buffer.

20. The composition of claim 17, further comprising one or more enzymes, a bleach system, and a pH buffer.

* * * * *